US011073009B2

(12) United States Patent
Chen et al.

(10) Patent No.: US 11,073,009 B2
(45) Date of Patent: Jul. 27, 2021

(54) DRILLING ENERGY CALCULATION BASED ON TRANSIENT DYNAMICS SIMULATION AND ITS APPLICATION TO DRILLING OPTIMIZATION

(71) Applicant: Schlumberger Technology Corporation, Sugar Land, TX (US)

(72) Inventors: Wei Chen, Katy, TX (US); Christopher Bogath, Richmond, TX (US); Richard John Harmer, Cambridg (GB); Yani Dong, Beijing (CN); Chanhui Bin, Beijing (CN); Yuelin Shen, Spring, TX (US); Sujian Huang, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 109 days.

(21) Appl. No.: 16/310,810

(22) PCT Filed: Jun. 29, 2016

(86) PCT No.: PCT/CN2016/087548
§ 371 (c)(1),
(2) Date: Dec. 17, 2018

(87) PCT Pub. No.: WO2018/000211
PCT Pub. Date: Jan. 4, 2018

(65) Prior Publication Data

US 2019/0178075 A1 Jun. 13, 2019

(51) Int. Cl.
*E21B 44/02* (2006.01)
*E21B 44/00* (2006.01)
(Continued)

(52) U.S. Cl.
CPC ..... *E21B 44/02* (2013.01); *E21B 44/00* (2013.01); *E21B 44/005* (2013.01); *E21B 10/54* (2013.01); *E21B 47/024* (2013.01)

(58) Field of Classification Search
CPC ..... E21B 10/54; E21B 44/00; E21B 44/005; E21B 44/02; E21B 47/024
See application file for complete search history.

(56) References Cited

U.S. PATENT DOCUMENTS 4,958,960 A 9/1990 Turner et al.
7,059,427 B2 6/2006 Power et al.
(Continued)

FOREIGN PATENT DOCUMENTS

WO 2012/080812 A2 6/2012
WO 2016/060881 A1 4/2016

OTHER PUBLICATIONS

International Preliminary Report on Patentability for the equivalent International patent application PCT/CN2016/087548 dated Jan. 10, 2019.
(Continued)

*Primary Examiner* — Caroline N Butcher
(74) *Attorney, Agent, or Firm* — Alec J. McGinn

(57) ABSTRACT

A method for drilling a well includes applying energy input to a drill string (31) by at least one of rotating the drill string (31) from surface and operating a drilling motor (41) disposed in the drill string (31) to operate a drill bit (2) at a bottom of the drill string (31); an amount of the applied energy not consumed in drilling formations caused by at least one of motion, deformation, and interaction of the drill string (31) is calculated; an amount of the applied energy used to drill formations below the drill bit (2) is calculated;
(Continued)

and at least one drilling operating parameter is adjusted based on energy calculation before or during drilling operation.

24 Claims, 20 Drawing Sheets

(51) Int. Cl.
*E21B 47/024* (2006.01)
*E21B 10/54* (2006.01)

(56) References Cited

U.S. PATENT DOCUMENTS

| | | | | |
|---|---|---|---|---|
| 7,139,689 | B2 | 11/2006 | Huang | |
| 7,140,452 | B2 | 11/2006 | Hutchinson | |
| 2013/0087385 | A1* | 4/2013 | Pena | E21B 7/24 175/24 |
| 2013/0146358 | A1* | 6/2013 | DiSantis | E21B 7/00 175/27 |
| 2014/0129148 | A1 | 5/2014 | Harmer et al. | |
| 2014/0158428 | A1 | 6/2014 | Boone et al. | |
| 2015/0083493 | A1* | 3/2015 | Wassell | E21B 44/00 175/40 |

OTHER PUBLICATIONS

Extended Search Report for the counterpart European patent application 16906613.1 dated Jan. 16, 2020.
Bailey, et al., "Development and Application of a BHA Vibrations Model," International Petroleum Technology Conference held in Kuala Lumpur, Malaysia, Dec. 3-5, 2008.
Bailey, et al., "Managing Drilling Vibrations Through BHA Design Optimization," Dec. 2010 SPE Drilling & Completion, pp. 458-471.
Bybee, "Drilling Vibrations Modeling and Field Validation," JPT, Dec. 2008, pp. 73-75.
International Search Report and Written Opinion for the equivalent International patent application PCT/CN2016/087548 dated Mar. 27, 2017.

* cited by examiner

- Kinetic energy due to translational movement

Calculate translational velocity at the center of mass $$\overrightarrow{v_c} = \frac{\overrightarrow{v_1} + \overrightarrow{v_2}}{2}$$

Calculate kinetic energy for each element and sum them up $$U_{KTran}(t_N) = \sum_{i=all\ ele} \frac{\left|\overrightarrow{v_{ci}(t_N)}\right|^2 m_i}{2}$$

- Kinetic energy due to axial rotation

Calculate axial rotation speed at the center of mass $$\omega_{xc} = \frac{\omega_{x1} + \omega_{x2}}{2}$$

Calculate kinetic energy for each element and sum them up $$U_{KRotX}(t_N) = \sum_{i=all\ ele} \frac{\omega_{xci}(t_N)^2 J_{xi}}{2}$$

$$J_x = \frac{m(OD^2 + ID^2)}{8}$$

- Kinetic energy due to tilt rotation

Calculate tilt rotation speed at the center of mass $$\omega_{tz} = \frac{v_{y1} - v_{y2}}{L} \qquad \omega_{ty} = \frac{v_{z1} - v_{z2}}{L}$$

Calculate kinetic energy for each element and sum them up $$U_{KRotTilt}(t_N) = \sum_{i=all\ ele} \frac{[\omega_{tzi}(t_N)^2 + \omega_{tyi}(t_N)^2]\, J_{yzi}}{2}$$

$$J_{yz} = \frac{mL^2}{12}$$

Axial Load $$U_{SE_Axial} = \frac{P^2 L}{2AE}$$

Torque $$U_{SE_Tor} = \frac{T^2 L}{2GJ}$$

Bending $$U_{SE_Bending} = \frac{M^2 L}{2EI}$$

DRILLING ENERGY CALCULATION BASED ON TRANSIENT DYNAMICS SIMULATION AND ITS APPLICATION TO DRILLING OPTIMIZATION

BACKGROUND

This disclosure relates generally to the field of drilling subsurface wellbores. More specifically, the disclosure relates to methods and apparatus for determining an amount of energy used to turn a drill string and/or sections thereof that is communicated to a drill bit used to drill through subsurface formations. Calculations of energy loss may be used to aid drilling job planning, drilling job execution and drilling job post evaluation.

Drilling is a process in which supplied energy and gravity act on a drill string from the surface, and/or by certain types of drilling motors coupled within the drill string. The energy is transferred through drill string, and is used to cut the formations at the bottom of the wellbore to extend its length. Part of the energy input may be converted to drill string elastic strain/kinetic energy; other portions of the input energy may be dissipated as thermal energy generated by frictional torque and axial drag between the drill string and the wall of the wellbore.

From an energy point of view, drilling optimization is a process used to minimize the energy loss due to drilling dynamics and to make as full use as practical of the energy input to the drill string to drill the formations.

Drilling energy analysis methods known in the art include, for example, "Vybs" bottom hole assembly (BHA) analysis model and energy-based performance indices. Descriptions of the foregoing may be found in Transactions of the International Petroleum Technology Conference (IPTC) Paper No., 12737-MS entitled, *Development and Application of a BHA Vibrations Model*. Other references include Society of Petroleum Engineers International (SPE) Paper No. 112650, *Drilling Vibrations Modeling and Field Validation*, and Paper No. 139426, entitled, *Managing Drilling Vibrations Through BHA Design Optimization.*

The methods described in the foregoing two SPE papers are based on a lumped-parameter model using the state vectors and transfer-function matrices. The state vector is a complete description of BHA response at any given position at given time. The total system response includes a static solution plus a dynamic perturbation about the static equilibrium state. In the foregoing described methods, the response of only the BHA section and one stand of heavy weight drill pipe (HWDP) are simulated. Two vibration excitation modes are utilized in the described methods: (1) flex mode wherein harmonic side force is applied at the drill bit, and the frequency is 1×, 2×, or 3× of input bit RPM, and (2) twirl mode, wherein identical mass eccentricity is applied at each model element. The performance parameters generated by such methods include:

BHA performance indices developed in the model;

BHA bending strain energy;

Transmitted bending strain energy;

Curvature index of BHA top-point; and

Contact force index.

U.S. Patent Application Publication No. 2014/0129148 entitled, Downhole determination of drilling state discloses using downhole measurements made by sensors in certain components of the BHA (accelerometer, magnetometer, and strain gauge) to calculate BHA strain and kinetic energy terms as follows:

Energy of axial motion and deformation;

Energy of rotational motion and deformation;

Energy of lateral motion and bending deformation; and wherein the total energy per unit length of BHA is obtained by summing the energy terms in different directions, and the foregoing terms can be used to detect changes in the operating state of the drill string and/or BHA automatically.

SUMMARY

One aspect of the disclosure relates to a method for drilling a well. A method according to this aspect of the disclosure includes applying energy to a drill string at at least one of a surface of the drill string and a motor disposed in the drill string to drive a drill bit at a bottom of the drill string. An amount of the applied energy not consumed in drilling formations caused by deformation and motion of the drill string is calculated. An amount of the applied energy used to drill formations below the drill bit is calculated. At least one of the bit, a bottom hole assembly component, and at least one drilling operating parameter is selected or adjusted based on energy calculation before or during drilling operation.

Other aspects and advantages of methods according to the disclosure will be apparent from the description and claims which follow.

DETAILED DESCRIPTION

Figure 1:
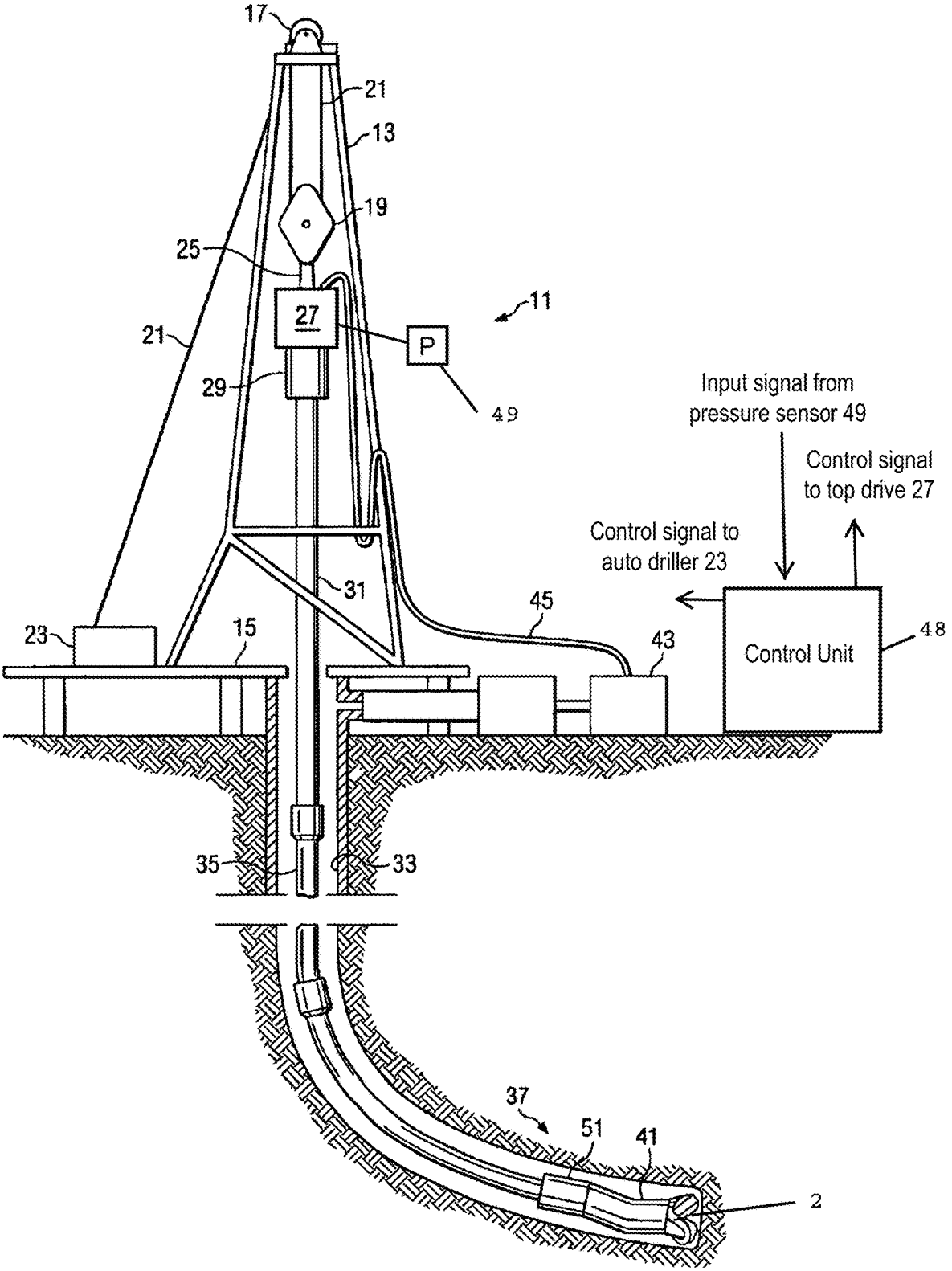
FIG. 1 is a pictorial view of a wellbore drilling system.

In FIG. 1, a drilling unit or "drilling rig" is designated generally at 11. The drilling rig 11 in FIG. 1 is shown as a land-based drilling rig. However, as will be apparent to those skilled in the art, the examples described herein will find equal application on marine drilling rigs, such as jack-up rigs, semisubmersibles, drill ships, and the like.

The drilling rig 11 includes a derrick 13 that is supported on the ground above a rig floor 15. The drilling rig 11 includes lifting gear, which includes a crown block 17 mounted to derrick 13 and a traveling block 19. The crown block 17 and the traveling block 19 are interconnected by a cable 21 that is driven by draw works 23 to control the upward and downward movement of the traveling block 19. The draw works 23 may be configured to be automatically operated to control rate of drop or release of the drill string into the wellbore during drilling. One non-limiting example of an automated draw works release control system is described in U.S. Pat. No. 7,059,427 issued to Power et al. and incorporated herein by reference.

The traveling block 19 carries a hook 25 from which may be suspended a top drive 27. The top drive 27 supports a drill string, designated generally by the numeral 31, in a wellbore 33. According to an example implementation, the drill string 31 may in signal communication with and mechanically coupled to the top drive 27 through an instrumented sub 29. As will be described in more detail, the instrumented top sub 29 may include sensors (not shown separately) that provide drill string torque information. Other types of torque sensors may be used in other examples, or proxy measurements for torque applied to the drill string 31 by the top drive 27 may be used, non-limiting examples of which may include electric current or hydraulic fluid flow drawn by a motor (not shown) in the top drive. A longitudinal end of the drill string 31 includes a drill bit 2 mounted thereon to drill the formations to extend (drill) the wellbore 33.

The top drive 27 can be operated to rotate the drill string 31 in either direction, as will be further explained. A load sensor 26 may be coupled to the hook 25 in order to measure the weight load on the hook 25. Such weight load may be related to the weight of the drill string 31, friction between the drill string 31 and the wellbore 33 wall and an amount of the weight of the drill string 31 that is applied to the drill bit 2 to drill the formations to extend the wellbore 33.

The drill string 31 may include a plurality of interconnected sections of drill pipe 35 a bottom hole assembly (BHA) 37, which may include stabilizers, drill collars, and a suite of measurement while drilling (MWD) and or logging while drilling (LWD) instruments, shown generally at 51.

A steerable drilling motor 41 may be connected proximate the bottom of BHA 37. The steerable drilling motor 41 may be any type known in the art for rotating the drill bit 2 and/or selected portions of the drill string 31 and to enable change in trajectory of the wellbore during slide drilling (explained in the Background section herein) or to perform rotary drilling (also explained in the Background section herein). Example types of drilling motors include, without limitation, positive displacement fluid operated motors, turbine fluid operated motors, electric motors and hydraulic fluid operated motors. The present example steerable drilling motor 41 may be operated by drilling fluid flow. Drilling fluid may be delivered to the drill string 31 by mud pumps 43 through a mud hose 45. In some examples, pressure of the drilling mud may be measured by a pressure sensor 49. During drilling, the drill string 31 is rotated within the wellbore 33 by the top drive 27, in a manner to be explained further below. As is known in the art, the top drive 27 is slidingly mounted on parallel vertically extending rails (not shown) to resist rotation as torque is applied to the drill string 31. During drilling, the bit 2 may be rotated by the steerable drilling motor 41, which in the present example may be operated by the flow of drilling fluid supplied by the mud pumps 43. Although a top drive rig is illustrated, those skilled in the art will recognize that the present example embodiment may also be used in connection with drilling systems in which a rotary table and kelly are used to apply torque to the drill string 31 at the surface. Drill cuttings produced as the bit 2 drills into the subsurface formations to extend the wellbore 33 are carried out of the wellbore 33 by the drilling mud as it passes through nozzles, jets or courses (none shown) in the drill bit 2. Although a steerable motor is shown in FIG. 1, in some embodiments, no drilling motor may be used, or a "straight" motor (one that is not intended to alter the wellbore trajectory) may be used to equal effect.

Signals from the pressure sensor 49, the hookload sensor 26, the instrumented top sub 29 and from an MWD/LWD system or steering tool 51 (which may be communicated using any known wellbore to surface communication system), may be received in a control unit 48. The control unit 48 may have a general purpose programmable computer (not shown separately) or may communicate with a different computer or computer system located remotely from the drilling rig 11 for data processing as will be further explained below.

In operating the drilling system shown in FIG. 1, certain operating parameters may be controlled by the drilling system operator (the driller). Such parameters include the hookload, the drill string RPM applied at surface, whether by the top drive as illustrated or by a rotary table. The drilling rig mud pump flow rate may also be controlled by the driller. If a directional drilling motor is used, the "toolface" angle (direction of a bend in the housing of such motor) may also be controlled by the driller. The foregoing may be referred to as "drilling operating parameters." The response of the drill string (including various modes of vibration) and the drill bit in drilling formations may be referred to as "drilling response parameters." In some embodiments, as will be further explained, one or more drilling operating parameters may be adjusted by the driller in order to optimize the amount of applied energy that is consumed by drilling formations, while minimizing the amount of energy dissipated in drill string actions that do not transfer energy to drilling the formations.

While the example embodiment of a drilling system shown in FIG. 1 applies energy to the drill string in the form of rotational energy (whether by rotating the drill string at the surface and/or operating a rotary-type drilling motor disposed in the drill string, methods according to the present disclosure are not limited to applying and using rotational energy in the drill string and/or drill bit. Other types of drilling systems and drill bits include, for example, and without limitation, percussion bits and percussion motors. A non-limiting example of an hydraulically powered percussion motor and associated drill bit are disclosed in U.S. Pat. No. 4,958,960 issued to Cyphelly.

Having explained a drilling system that may be used in some embodiments, methods according to the present disclosure that may be used to calculate: (i) an amount of the input energy that is actually expended in drilling through formations; and (ii) the amount of the total energy input is dissipated in various modes which do not contribute to extension of the wellbore.

Figure 2A:
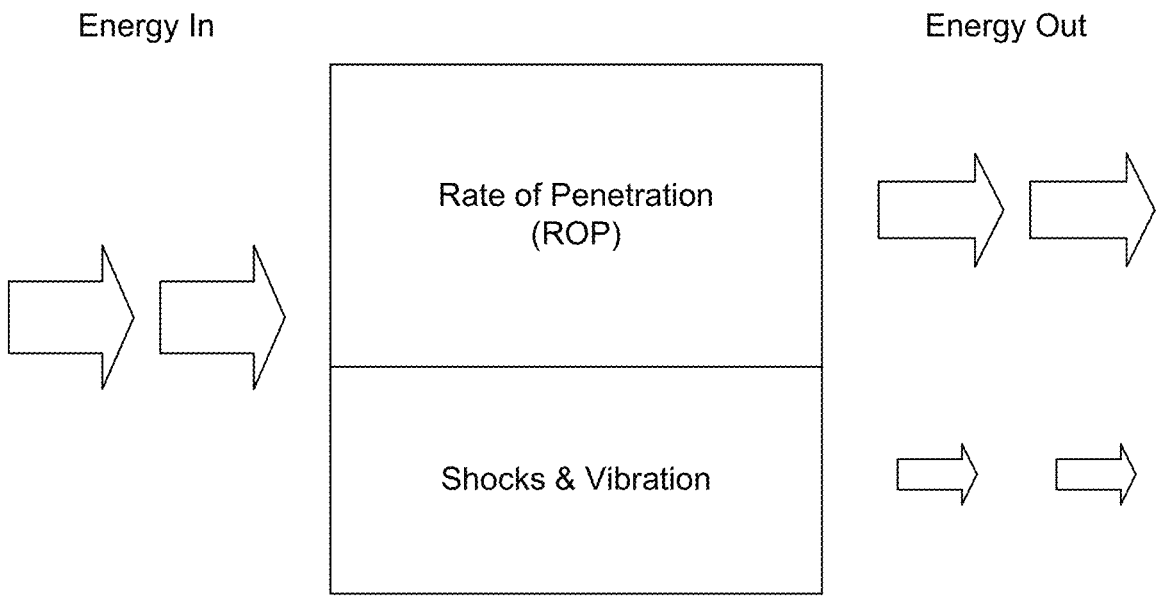
FIG. 2A shows a schematic representation of energy input to a drill string and main mechanisms by which such energy is consumed.
Figure 2B:
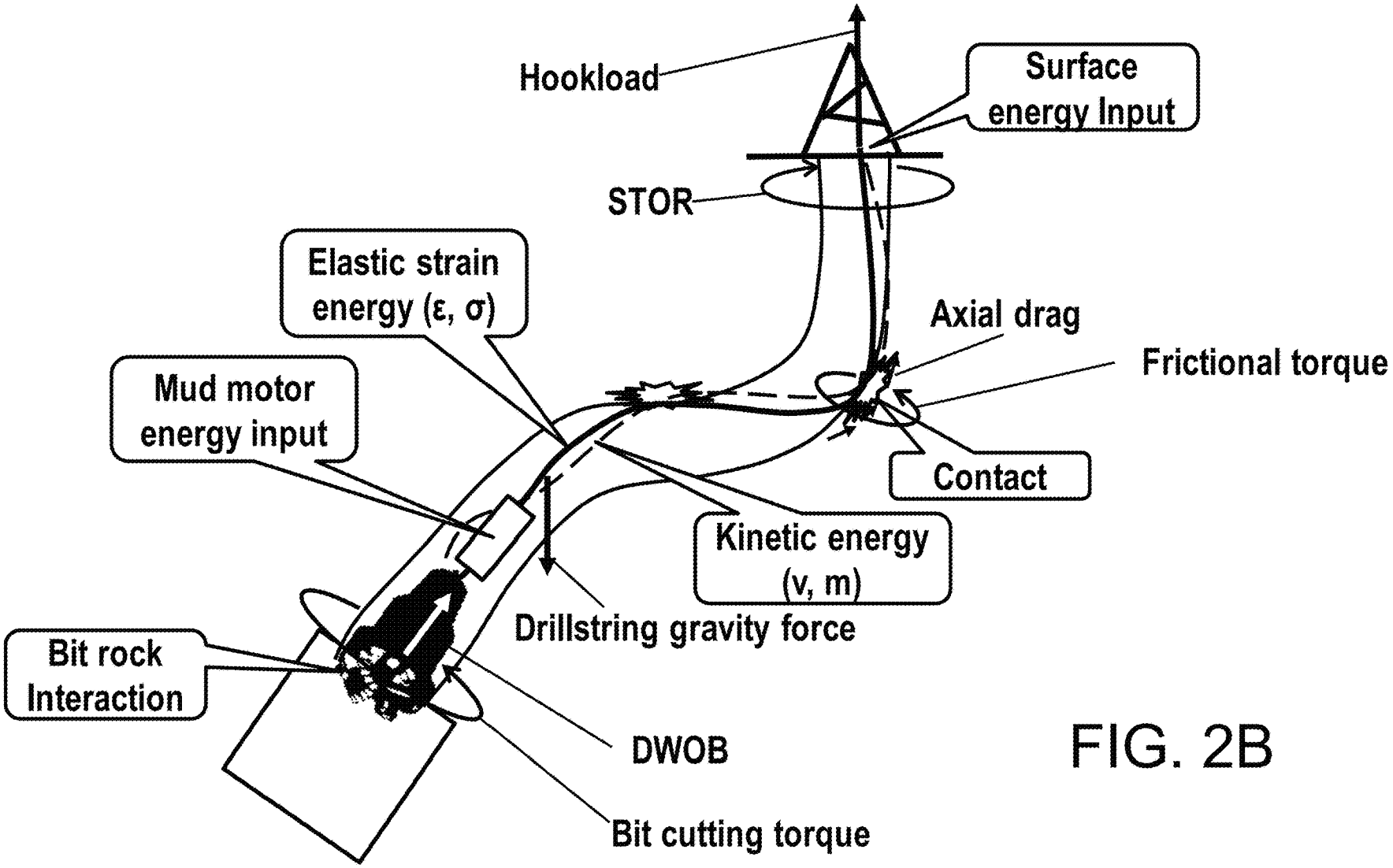
FIG. 2B shows various elements of a sample drill string operating in a wellbore to illustrate in more detail the mechanisms that consume the energy input to the drill string.
Figure 3:
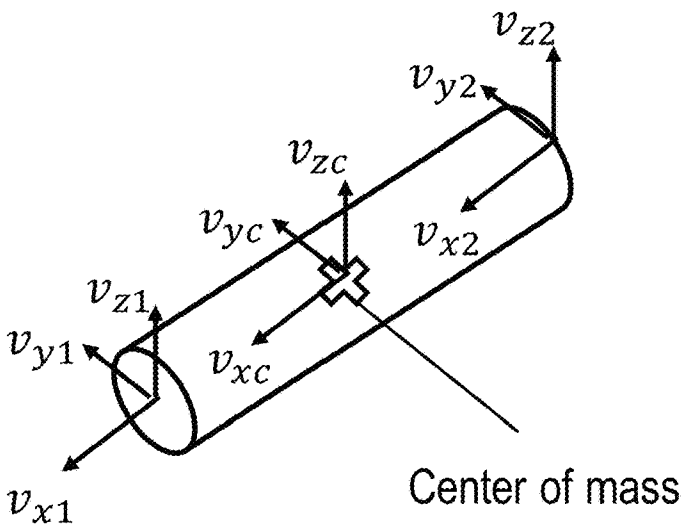
FIG. 3 shows schematically how energy applied to the drill string is consumed by axial motion.
Figure 4:
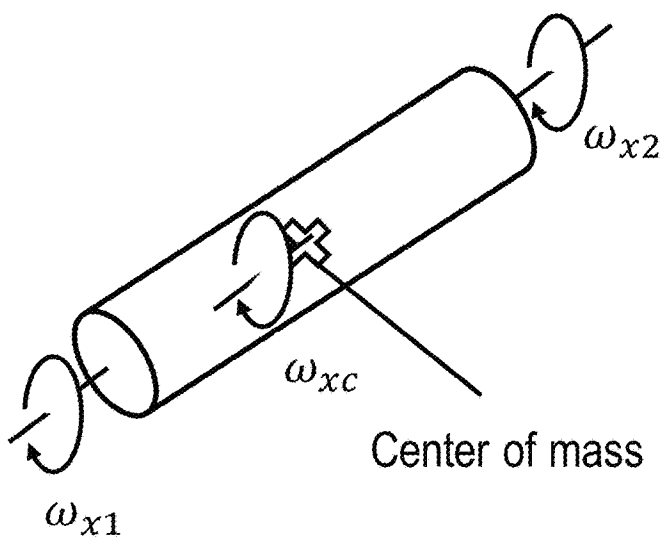
FIG. 4 shows schematically how energy applied to the drill string is consumed by axially oriented rotation.

Consider the drill string as a dynamic system. System energy input may be from a surface top drive (or kelly/rotary table as explained with reference to FIG. 1) and/or a drilling motor disposed in the drill string. Effective use of the input energy is to drill and remove the formation (i.e., lengthening the wellbore). However, some of all of the input energy may be dissipated due to shock, vibration and frictional contact between the drill string and the wall of the wellbore. The purpose of drilling optimization according to the present disclosure is to minimize the energy loss caused by, e.g., and without limitation the foregoing interactions of the drill string. The foregoing is illustrated schematically in FIG. 2A in the general sense. FIG. 2B shows a schematic illustration of the various interactions between the drill string and the wellbore to better define the parameters which cause loss of energy applied to the drill string that would ideally be used to drill the formations. The input energy to the entire drill string is shown at the rig (top drive or rotary table). Additional energy may be input proximate the BHA using a drilling motor as shown in FIG. 2B. Sources of energy consumption include drilling the formations, indicated by Bit/Rock interaction in FIG. 2B. Energy losses, i.e., energy not used in drilling the formation may result from Elastic strain energy ($\varepsilon$, $\sigma$) due to bending moment, torque, and axial force, contact between the wall of the wellbore and the drill string (which may cause both rotational and longitudinal friction). Kinetic energy of axial motion of the drill string (FIG. 3), rotation of the drill string (FIG. 4), tilt motion of the drill string (FIG. 5) and lateral motion of the drill string (FIG. 3).

In a method according to the present disclosure, the entire drill string may be "meshed" into a finite element analysis (FEA) program of types well known in the art. The mesh size is a matter of discretion for the system user or designer and may be selected to provide results to a size range consistent with the user's or designer's objectives. One example of such program as applied to dynamic drill string analysis is disclosed in U.S. Pat. No. 7,139,689 issued to Huang and incorporated herein by reference.

First, the energy that is input to the drill string may be calculated based on hookload (suspended drill string weight in the drilling rig), on torque applied by the top drive (or rotary table) and torque applied by the drilling motor (if used).

The work (energy input) done by top drive or rotary table torque (STOR) may be defined by the expression"

$$W_{STOR}=\int \mathrm{STOR}\cdot d(\mathrm{REV}_{table}) \tag{1}$$

wherein $\mathrm{REV}_{table}$ represents the surface rotation revolution imparted to the drill string.

The work by hookload may be defined as:

$$W_{HL}=-\int \mathrm{HookLoad}\cdot d(\mathrm{MD}) \tag{2}$$

wherein MD is the measured depth of drill string, and the negative sign indicates that the direction of increased measured depth is opposite to the direction of hookload.

The work by net drill string weight may be represented by:

$$W_{WT}=\int[\int WT_{DS}(x)\cdot\cos(Inc(x))\cdot dx]\cdot d(\mathrm{MD}) \tag{3}$$

where $\mathrm{WT}_{DS}(x)$ is the wet weight distribution of drill string versus the distance x, Inc(x) is the inclination of drill string from vertical versus the distance x. The surface weight on bit (SWOB) may be determined by the expression:

$$\mathrm{SWOB}=\int WT_{DS}(x)\cdot\cos(Inc(x))\cdot dx-\mathrm{HookLoad} \tag{4}$$

The total energy applied to the drill string from the surface may be expressed as:

$$W_{input}=W_{STOR}+W_{HL}+W_{WT}=\int \mathrm{STOR}\cdot d(\mathrm{REV}_{table})+\int \mathrm{SWOB}\cdot d(\mathrm{MD}) \tag{5}$$

If a drilling motor is used, its energy applied to that portion of the drill string below the axial position of the drilling motor, in the case of a positive displacement motor, may be calculated by the expression:

$$W_{input_PDM}=\int P_{diff}\cdot dQ \tag{6}$$

wherein $P_{diff}$ is the pressure drop cross the motor, and Q the flow volume passing the motor. Corresponding expressions for energy input from a drilling motor that is a turbine type are known in the art. When both surface rotation of the drill string and a motor are used, the total energy applied to the drill string will be the sum of Eqs. (5) and (6).

It will be appreciated that by using FEA transient dynamics simulation, each discrete time interval will have the foregoing parameters calculated; the integral sign is intended to represent that the total energy is the sum of the energy generated within each discrete time interval in transient dynamics simulation. From the transient dynamics simulation, the axial displacement, rotational revolution of top node (representing surface), surface weight-on-bit, and surface torque at the discrete time point $t_n$ are output and represented by $ux_{top}(t_n)$, $\mathrm{REV}_{table}(t_n)$, $\mathrm{SWOB}(t_n)$, and $\mathrm{STOR}(t_n)$ respectively. One can calculate the surface energy input to drill string using the classic trapezoidal numerical integration method.

$$W_{input}(t_N)=\sum_{i=1\ldots N}\frac{[SWOB(t_i)+SWOB(t_{i-1})]\cdot[ux_{top}(t_i)-ux_{top}(t_{i-1})]}{2}+ \tag{7}$$

-continued $$\sum_{i=1\ldots N} \frac{[STOR(t_i) + STOR(t_{i-1})] \cdot [REV_{top}(t_i) - REv_{top}(t_{i-1})]}{2}$$

Here, $W_{input}(t_N)$ is the surface energy input at time $t_N$.

Following the same procedure, one can calculate the motor input to drill string as:

$$W_{input_PDM}(t_N) = \sum_{i=1\ldots N} \frac{[P_{diff}(t_i) + P_{diff}(t_{i-1})] \cdot [Q(t_i) - Q(t_{i-1})]}{2} \quad (8)$$

Here, $W_{input_PDM}(t_n)$, $P_{diff}(t_n)$, and $Q(t_n)$ are motor energy input, motor differential pressure, and flow volume at time tn.

Once the total energy applied to the drill string is calculated, various parameters that consume energy (including that used in drilling formations) may be calculated so as to enable determining how the input energy is distributed.

Reaction axial force at the drill bit (DWOB) and torque at the drill bit (DTOB) are generated as bit cuts the rock. Energy used by drilling formations equals to the work done by the DWOB and DTOB as in the following expression:

$$W_{drilling} = \int DWOB \cdot d(MD_{bit}) + \int DTOB \cdot d(REV_{bit}) \quad (9)$$

wherein $REV_{bit}$ is the rotation revolution of bit, and $MD_{bit}$ is the axial drill ahead distance at bit. The integration can be also evaluated using the trapezoidal numerical integration method based on the transient dynamics simulation outputs.

$$W_{drilling}(t_N) = \sum_{i=1\ldots N} \frac{[DWOB(t_i) + DWOB(t_{i-1})] \cdot [ux_{bit}(t_i) - ux_{bit}(t_{i-1})]}{2} + \sum_{i=1\ldots N} \frac{[DTOB(t_i) + DTOB(t_{i-1})] \cdot [REV_{bit}(t_i) - REV_{bit}(t_{i-1})]}{2} \quad (10)$$

wherein $W_{drilling}(t_n)$, $DWOB(t_n)$, $DTOB(t_n)$, $ux_{bit}(t_n)$, and $REV_{bit}(t_n)$ are rock drilling energy, axial force on bit, torque on bit, bit axial displacement, and bit rotational revolution at time $t_n$ respectively.

The strain energy is mechanical energy stored in an elastic material upon deformation caused by mechanical loading. The strain energy may be expressed as:

$$U_{Strain} = \tfrac{1}{2}\int \varepsilon\sigma dV \quad (11)$$

Figure 6:
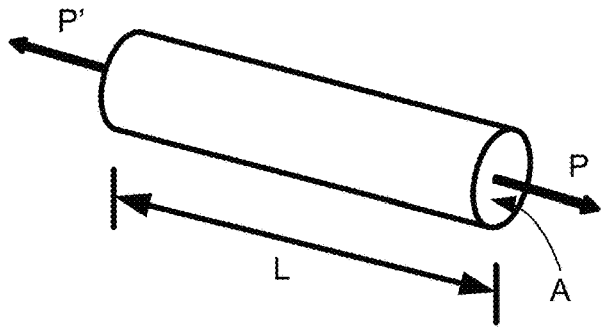
FIG. 6 shows schematically how energy applied to the drill string may be consumed by various strain sustained by the drill string.
Figure 6:
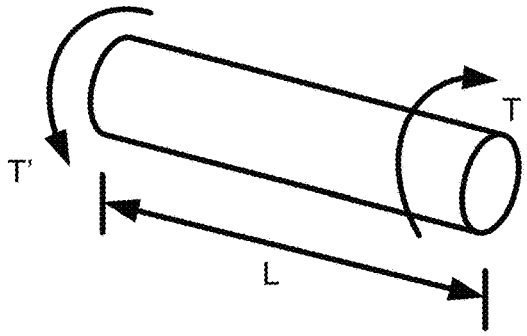
Figure 6:
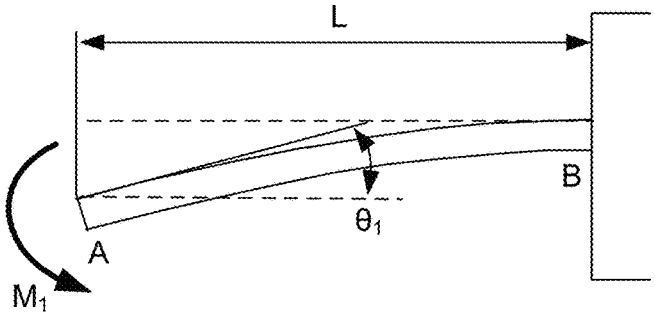

For a drill string, the strain energy can be decomposed into three parts: (i) torsional strain energy resulting from torque; (ii) bending strain energy caused by bending moment; (iii) tensile strain energy caused by axial force. The shear strain (energy) due to shear force is negligible as predicted by the Euler-Bernoulli theory. Consider a beam with uniform cross section. The foregoing strain energy components may be calculated according to the respective formulas shown in FIG. 6. For axial loading, the strain energy may be calculated by the expression:

$$U_{SE_Axial} = \frac{P^2 L}{2AE} \quad (12)$$

wherein P is axial force, L the beam length, A the cross section area, and E is elastic modulus.

Torsional strain energy may be calculated by the expression:

$$U_{SE_Tor} = \frac{T^2 L}{2GI_x} \quad (13)$$

wherein T is the externally applied torque, G the shear modulus, and $I_x$ the area moment of inertia about the beam axis.

and bending strain energy may be calculated by the expression:

$$U_{SE_Bending} = \frac{M^2 L}{2EI_{yz}} \quad (14)$$

Wherein M is the applied bending moment, and $I_{yz}$ is the bending moment of inertia.

In numerical method (FEA) mentioned in this disclosure, the drill string is meshed using beam elements. For each beam element, the foregoing strain energy parameters are calculated using Eq. (12-14). The total strain energy of drill string are the sum of strain energy of each mesh element.

$$U_{Strain}(t_N) = \sum_{i=all\ ele} \left[ \frac{P_i(t_N)^2 L_i}{2A_i E} + \frac{T_i(t_N)^2 L_i}{2I_{x,i} G} + \frac{M_i(t_N)^2 L_i}{2I_{yz,i} E} \right] \quad (15)$$

Here, $U_{strain}(t_N)$ is the total strain energy at time $t_N$. $P_i(t_N)$, $T_i(t_N)$, and $M_i(t_N)$ are the axial force, torque, and bending moment on i-th FEA beam element at time $t_N$. $A_i$, $I_{x,i}$, and $I_{yz,i}$ are cross section area, area moment of inertia, and bending moment of inertia of i-th FEA beam element.

Kinetic energy is the energy that an object possesses due to its motion. The kinetic energy may be decomposed into a translation component and a rotary component. The foregoing kinetic energy components are illustrated with formulas for calculating them, respectively, in FIGS. 3 and 4. For each FEA beam element, kinetic energy of axial or lateral translational motion may be calculated by the expression:

$$U_{KTran} = \tfrac{1}{2} m |\vec{v}|^2 \quad (16)$$

Here, m is the mass of the beam element, and v the translational velocity vector of mass center of element.

Axial rotational kinetic energy may be calculated by the expression:

$$U_{KRot} = \tfrac{1}{2} J_x \omega^2 \quad (17)$$

Here, $J_x$ is the polar mass moment of inertia of the beam element, and co the axial rotation speed.

Figure 5:
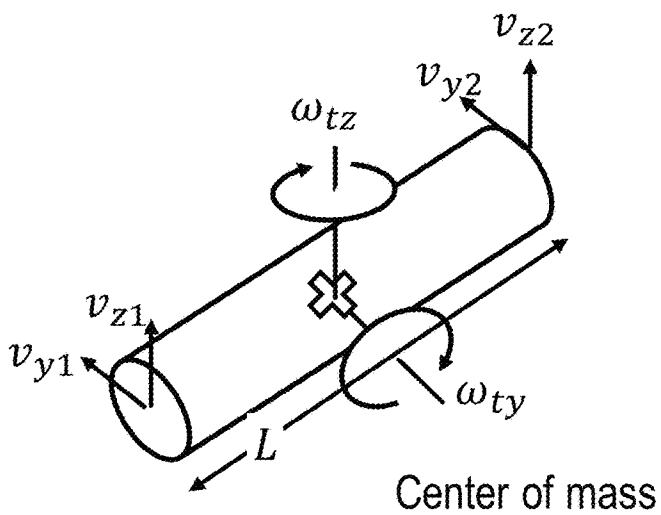
FIG. 5 shows schematically how energy applied to the drill string is consumed by tilt of the drill string.

Kinetic energy used to tilt the axis of one FEA beam element is illustrated with a formula in FIG. 5. The tilt rotation kinetic energy may be calculated by the expression:

$$U_{KRotTilt} = \tfrac{1}{2} J_{yz} \omega_{tilt}^2 \quad (18)$$

wherein $J_{yz}$ is the mass moment of inertia about axis located at beam center and perpendicular to beam axis, and $\omega_{tilt}$ the tilt rotation speed.

The total kinetic energy of drill string are the sum of kinetic energy calculated on each FEA element.

$$U_{Kinetic}(t_N) = \sum_{i=all\ ele} [U_{KTran,i}(t_N) + U_{KRot,i}(t_N) + U_{KRotTilt,i}(t_N)] \quad (19)$$

Here, $U_{Kinetic}(t_N)$ is the total kinetic energy at time $t_N$. $U_{KTran,i}(t_N)$, $U_{KRot,i}(t_N)$, and $U_{KRotTilt,i}(t_N)$ are the translational, axial rotational, and tilt rotational kinetic energy of i-th FEA beam element at time $t_N$.

Energy loss in the drilling process is defined as the energy consumed by the work done by contact friction and all types of damping mechanisms (like contact restitution and material damping). Considering the principle of conservation of energy, the energy loss $W_{loss}(t_N)$ at time $t_N$ can be expressed as:

$$W_{loss}(t_N)W_{input}(t_N)+W_{input_PDM}(t_N)-W_{drilling}(t_N)-U_{Strain}(t_N)-U_{Kinetic}(t_N) \quad (20)$$

Figure 7:
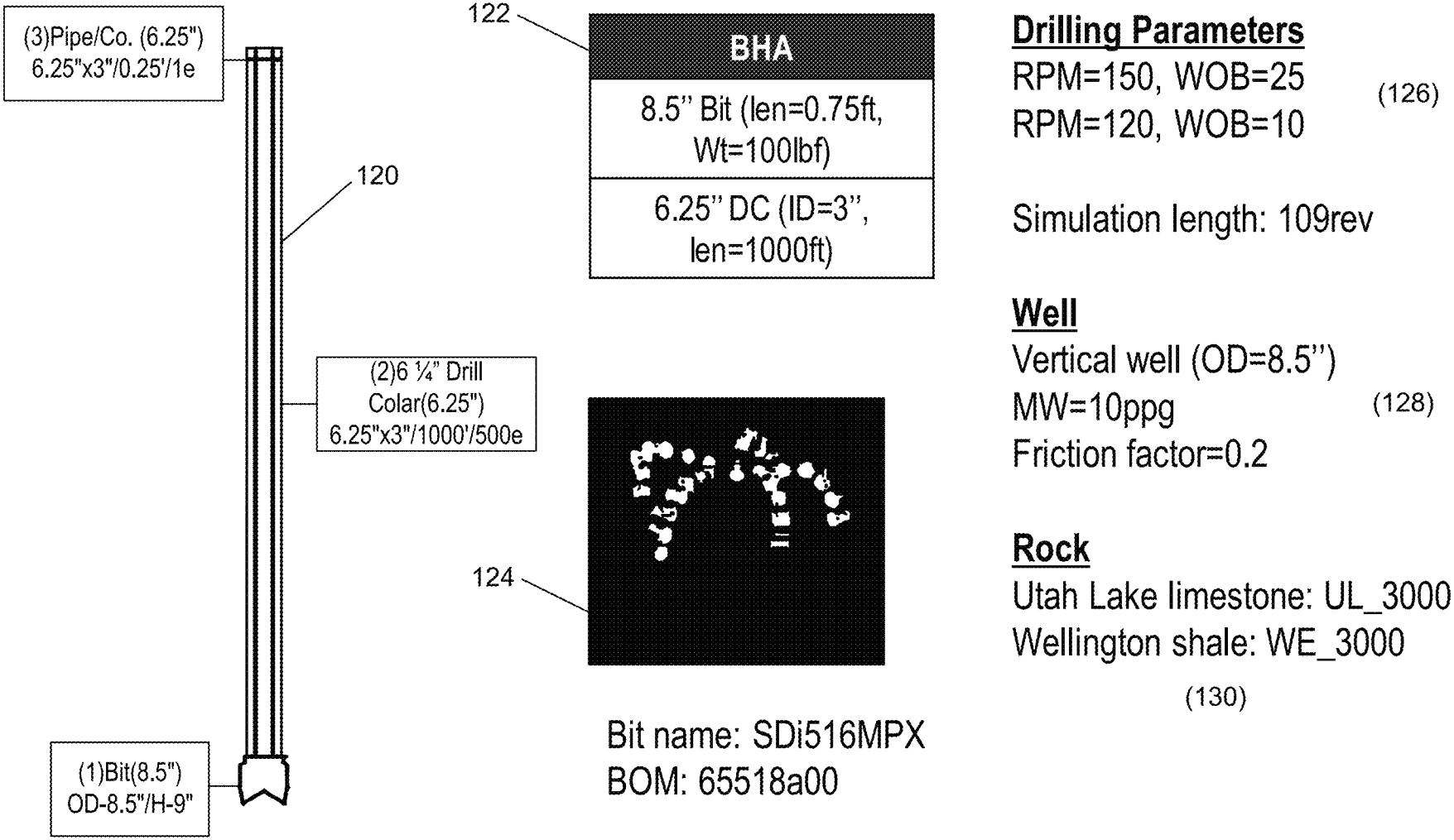
FIG. 7 shows an example of parameters used in a model according to the present disclosure wherein all rotational energy is applied to the drill string from the surface.

An example set of calculations using a method according to the present disclosure may be better understood with reference to FIG. 7. A drill string is illustrated schematically at 120. The drill string has selected diameter (internal and external), selected weight, selected moment of inertia, selected elastic properties and a drill bit at a bottom end thereof. Components of the BHA and their respective mechanical properties are shown at 122. Arrangement of cutting elements and other mechanical properties of the drill bit are shown at 124. Drilling operating parameters (weight on bit, drill string rotational speed) used in the calculations are shown at 126. Mechanical interaction properties between the formation (wellbore) and the drill string are shown at 128. Finally at 130, properties of the formation (rock) being drilled are illustrated. The present example simulation was conducted for 109 revolutions of the drill string. It will be appreciated that any other simulation may be performed for more or fewer drill string rotations as the user may find desirable. Because all of the forces acting on each meshed element of the drill string are calculated, a simulation conducted according to the present disclosure can also calculate the drill string mode of motion, e.g., and without limitation, normal rotary drilling with determinable contact points/lengths between the drill string and the wellbore wall, stick slip motion, lateral vibration of the drill string and/or BHA, whirling motion and axial vibration. As will be explained below, the mode of motion may have a substantial effect on the amount of total applied energy that is ultimately consumed by drilling formations, rather than being dissipated by one or more of the above described mechanisms.

Figure 8:
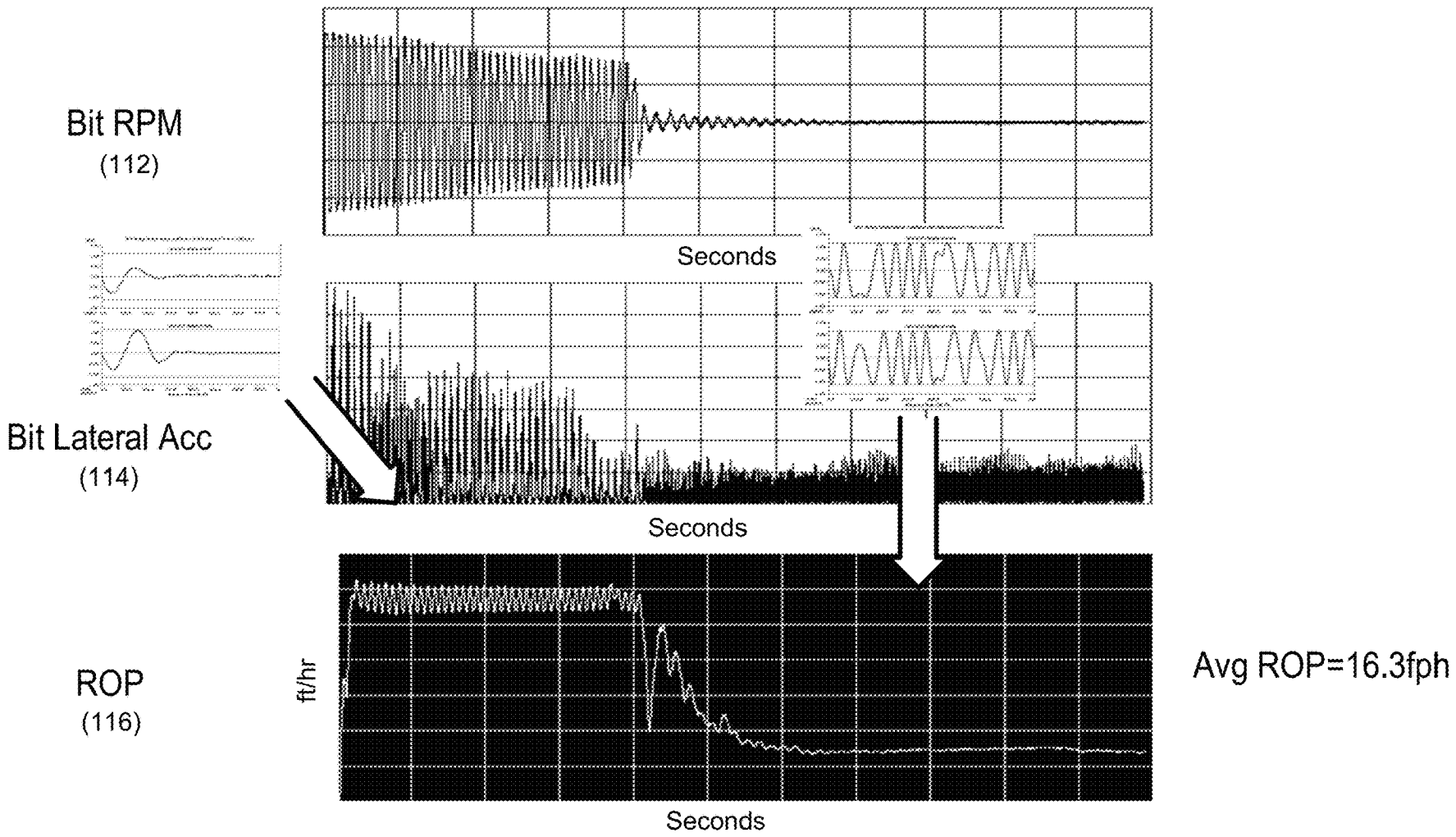
FIG. 8 shows graphs of simulated bit rotational speed (RPM), bit lateral acceleration and bit rate of penetration through formations using the parameters shown in FIG. 7.

Results of the above simulation are shown graphically in FIG. 8. FIG. 8 includes graphs of bit RPM, lateral acceleration on the bit and the rate of drilling the formation (rate of penetration—ROP). It may be observed in FIG. 8 that at about 16 seconds, the drill string movement mode changes from "stick-slip" (wherein the drill string becomes momentarily stuck in the wellbore and subsequently is freed to rotate) to "backward whirl" (wherein the axis of the drill string precesses in a direction opposite the rotation of the drill string) and correspondingly consumes energy by frictional contact with the wellbore wall. It may be observed that the ROP drops substantially when the movement mode changes to backward whirl.

Figure 9:
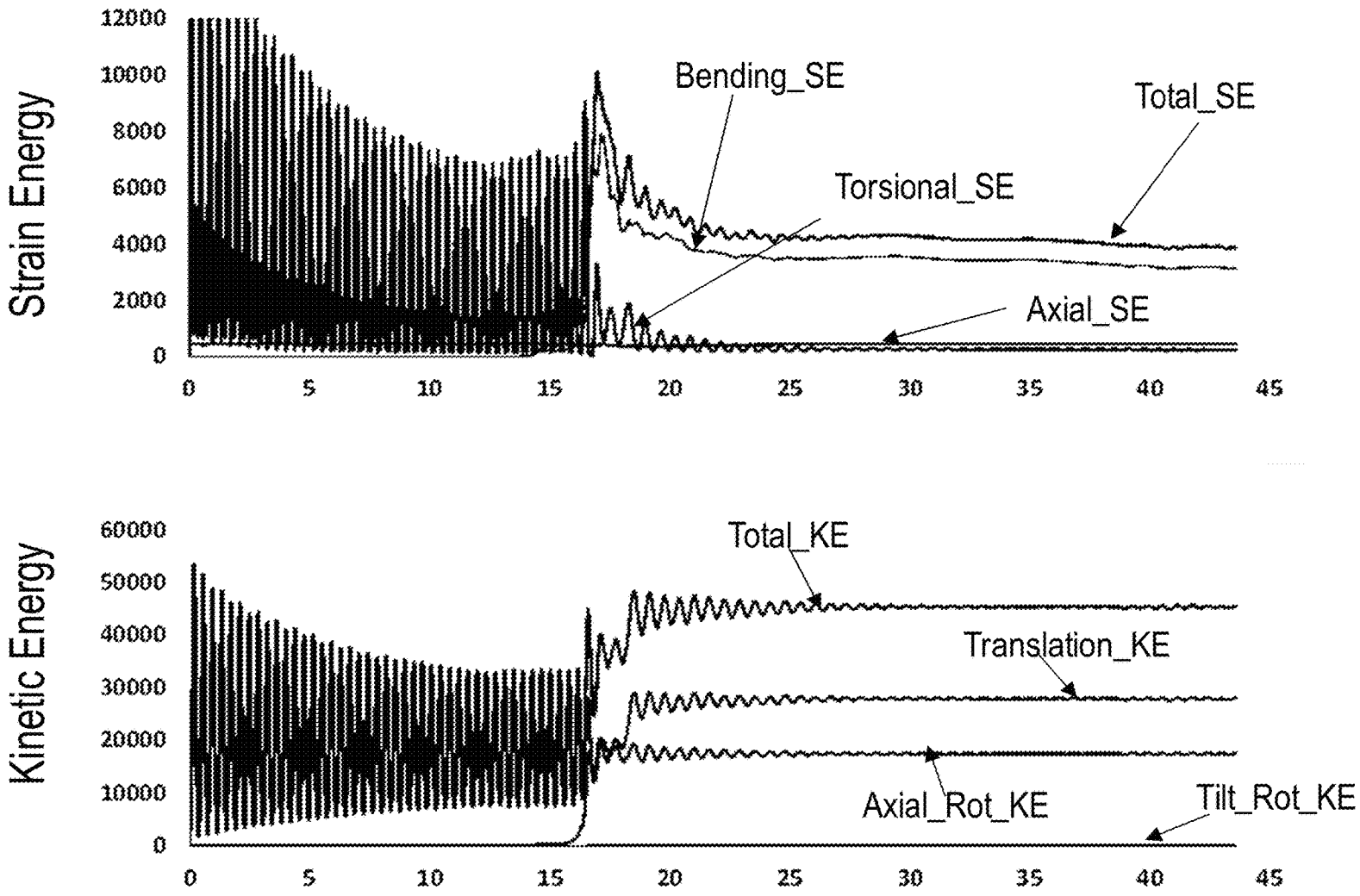
FIG. 9 shows graphs of strain and kinetic energy when the drill string undergoes a state change from stick-slip motion to whirling motion.

FIG. 9 shows graphs of both strain and kinetic energy for the same set of conditioned used to generate the graphs shown in FIG. 8. During stick-slip, bending strain energy and translation kinetic energy terms are negligible compared to torsional strain energy and axial rotation kinetic energy. As whirling begins, bending strain energy and translation kinetic energy increase dramatically, and oscillation of torsional strain and kinetic energy substantially vanish because the bit RPM becomes stable.

Figure 10:
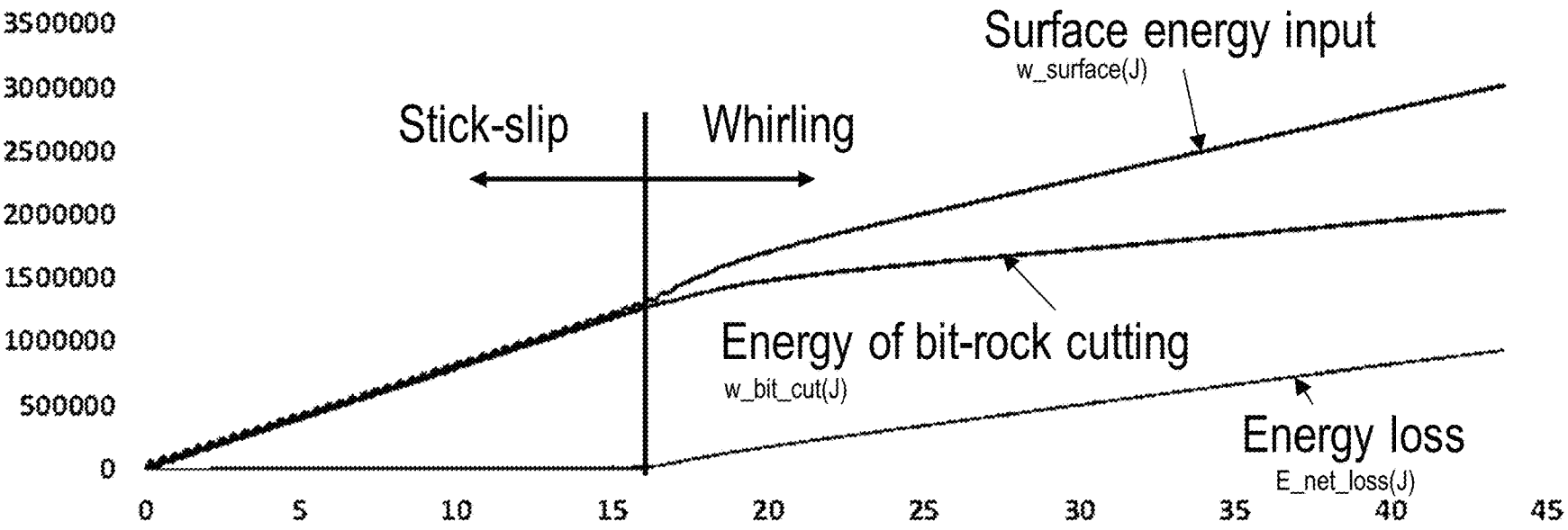
FIG. 10 shows a graph illustrating that during initial drilling, almost all the surface input energy is used to cut the rock although the bit has stick-slip motion. After entering whirling mode, more of the input energy is lost due to the increased contact interactions between drill string and wellbore.

FIG. 10 shows a graph that illustrates during initial drilling, almost all the surface energy input is used to drill the formation. After entering whirling mode, more energy is lost due to the increased contact interactions between the drill string and the wellbore.

Figure 11:
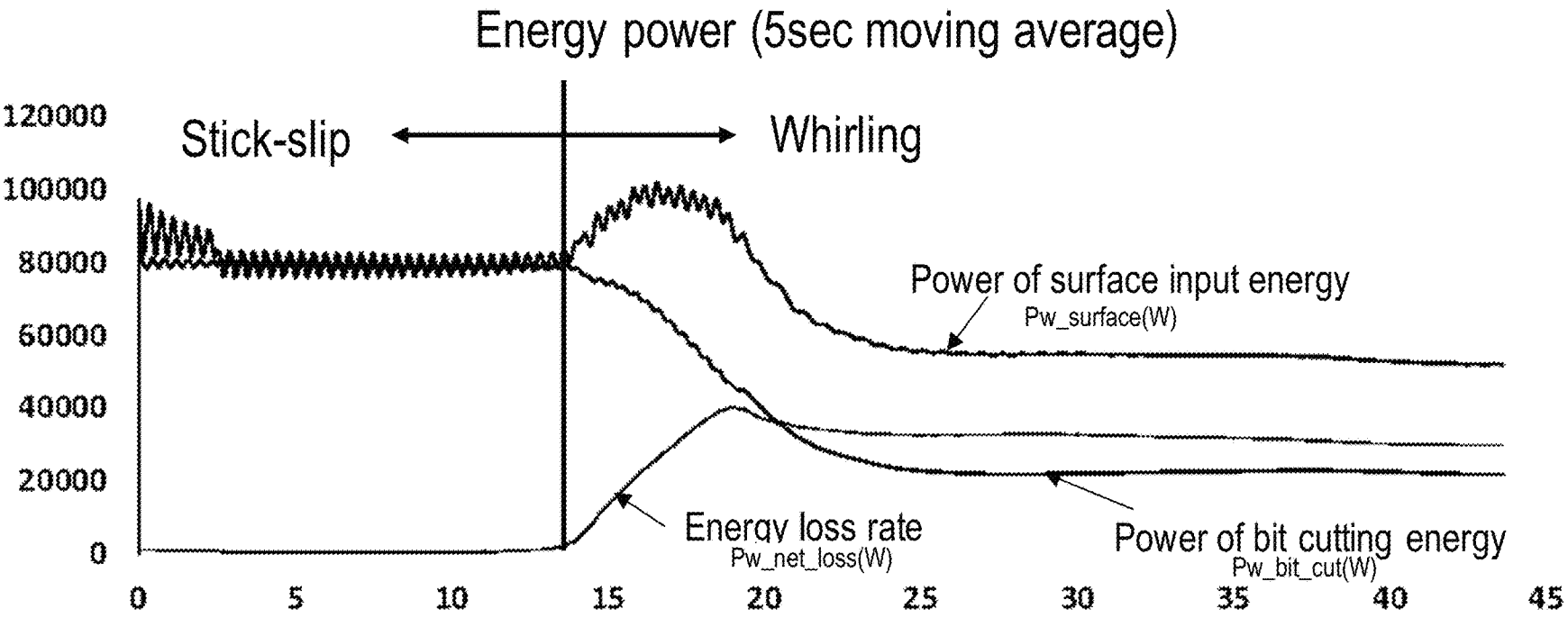
FIG. 11 shows another graph including time averaged power wherein during initial drilling, almost all the surface energy input is used to cut the rock. After entering whirling mode, more energy is lost due to the increased contact interactions between drill string and wellbore. In this case, only about 40% energy input from surface is used for rock cutting during whirling mode.

FIG. 11 shows a graph or applied and consumed power for the simulation shown with reference to FIG. 9. As may be observed in FIG. 11, during initial drilling, almost all the surface energy input is used to drill the formation. After entering whirling mode, more energy is lost due to the increased contact interactions between drill string and wellbore. In this case, only about 40% energy input from surface is used for formation drilling in whirl mode.

It will be appreciated that while stick-slip drilling results in much higher transfer of energy applied to the drill string into drilling formation, stick-slip drilling should be carefully monitored for excessive buildup of torque in the drill string and its sudden release. U.S. Pat. No. 7,140,452 issued to Hutchinson discloses how under certain circumstances, torsional stick-slip may result in the released torque causing certain drill string components to rotationally accelerate such that the breaking torque of threaded connections is exceeded. When selecting drilling operating parameters for use in a method according to the present disclosure, maximum rotational acceleration on torsional release of any part of the drill string should be determined, such that the breaking torque is not exceeded.

Figure 12:
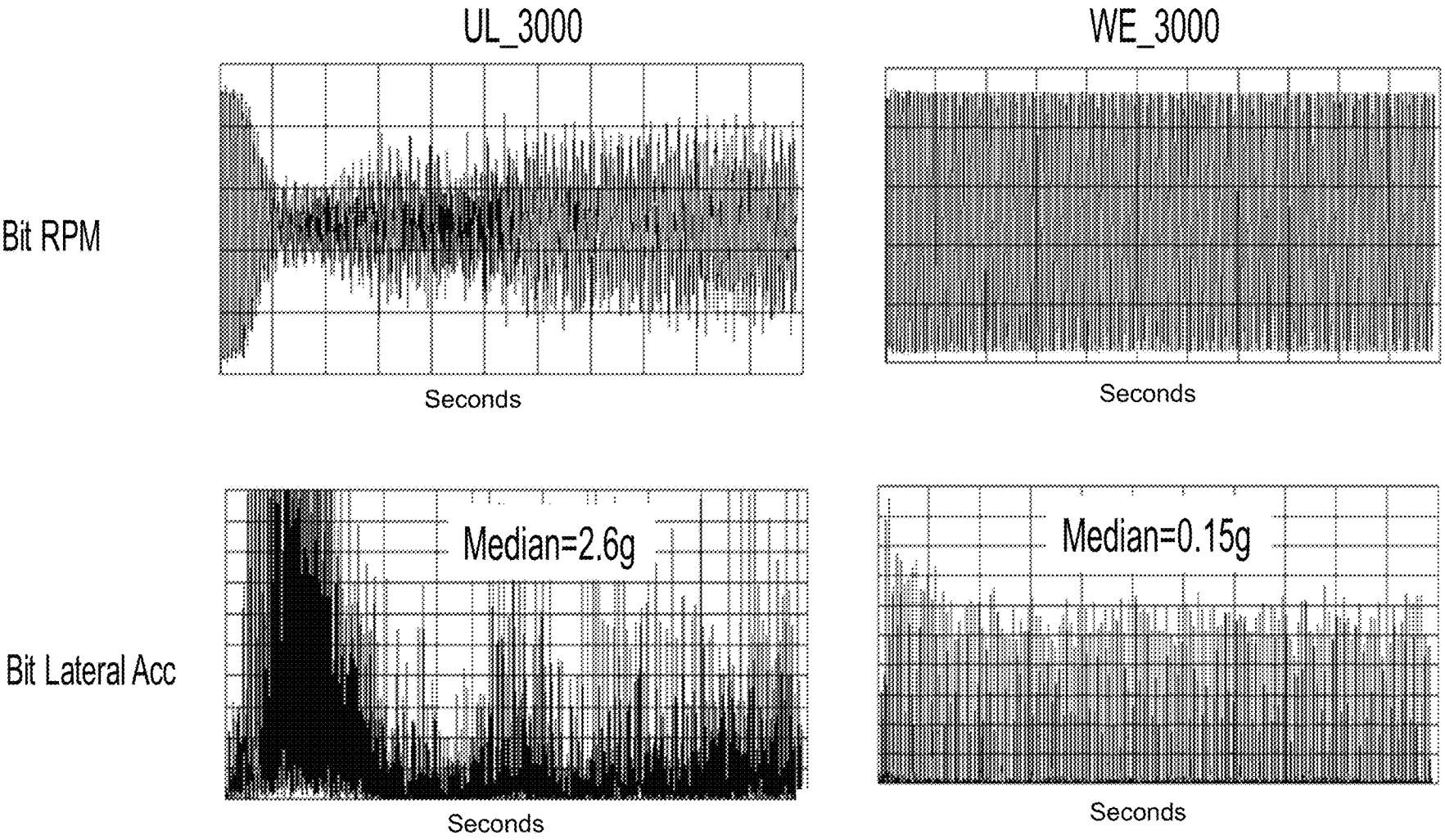
FIG. 12 shows graphs illustrating that drilling hard formations results in a lower RPM variation and higher lateral vibration.

FIG. 12 shows a comparison of results obtained for hard formations (designated UL_3000) as contrasted with softer formations (designated WE_3000). From the graphed results, it may be readily determined that harder formations tend to have higher lateral vibration on the drill bit and lower bit RPM variation for the used set of drilling operating parameters.

Figure 13:
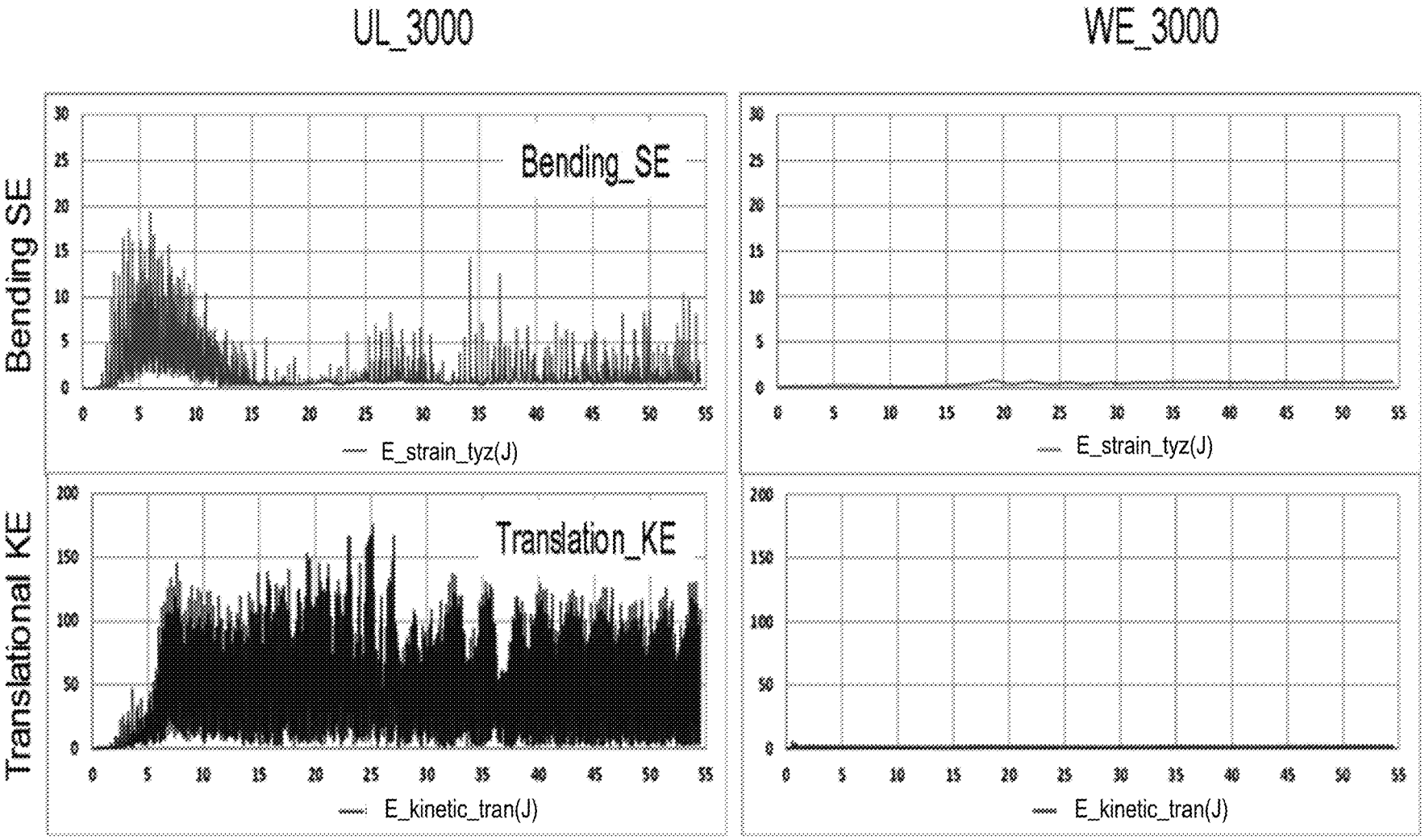
FIG. 13 shows graphs of a comparison of drilling two different formations. Drilling hard formation shows much higher bending strain energy and translational kinetic energy. Since bending and translational energies are calculated based on the entire BHA, it is possible to use the foregoing measured at the BHA as lateral vibration indices of the entire BHA.

FIG. 13 shows graphs of bending strain energy (SE) and translational kinetic energy (KE) when drilling hard formations (UL_3000) as contrasted with softer formations (WL_3000). Drilling hard formation (UL_3000) shows much higher bending strain energy and translational kinetic energy.

Since bending SE and translational KE are calculated based on the entire BHA, these parameters can be used as lateral vibration indices for the entire BHA.

Figure 14:
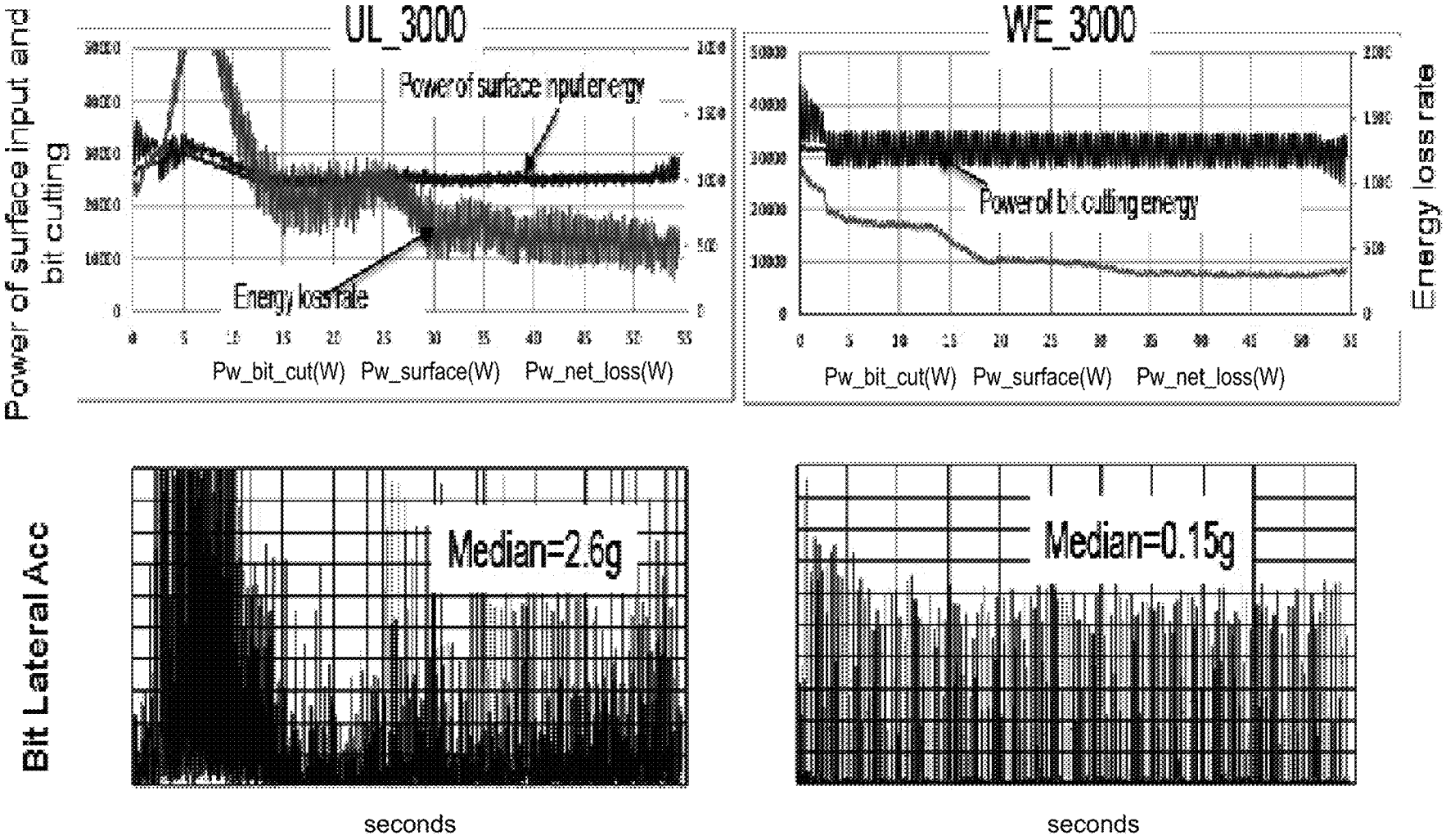
FIG. 14 shows graphs indicating that in terms of ratio of energy loss with reference to energy input, more energy is dissipated by wellbore wall contact interactions in hard rock drilling. This matches the trend of lateral acceleration of the two different formation cases (more lateral acceleration means more wellbore contact and more energy loss).

FIG. 14 shows graphs for the same formations of the power transmitted to the bit for drilling the formations and the lateral acceleration experienced by the drill bit. In terms of the ratio of energy loss to energy input, more energy is dissipated by contact interactions in hard rock drilling (UL_3000). The foregoing is consistent with the trend of lateral acceleration of two cases (more lateral acceleration means more wellbore contact and more energy loss). It is contemplated that the energy loss ratio could be used an indicator of drilling efficiency.

Figure 15:
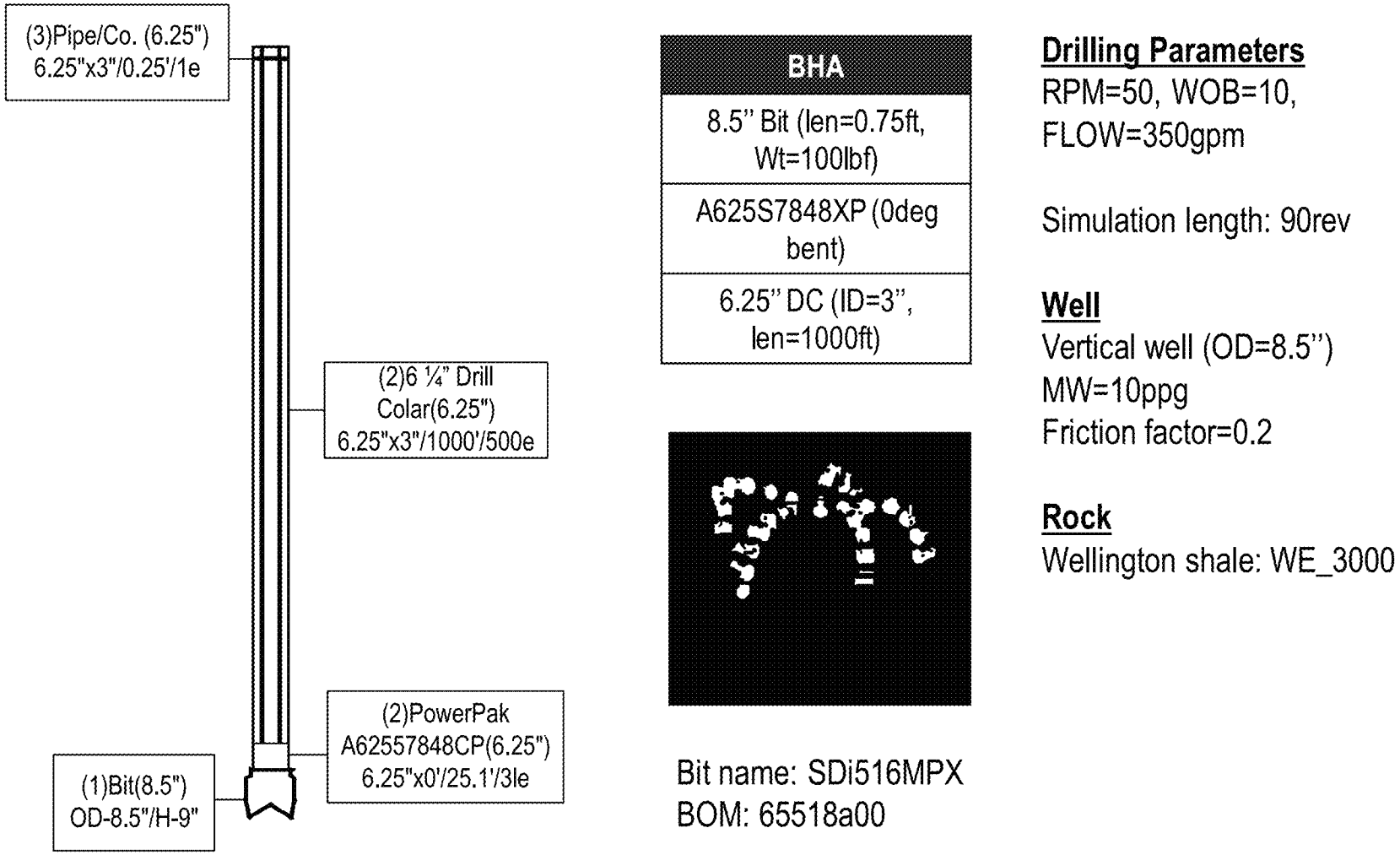
FIG. 15 shows a schematic diagram of parameters to be modeled using an example embodiment according to the disclosure wherein a drilling motor is included in the drill string.
Figure 16:
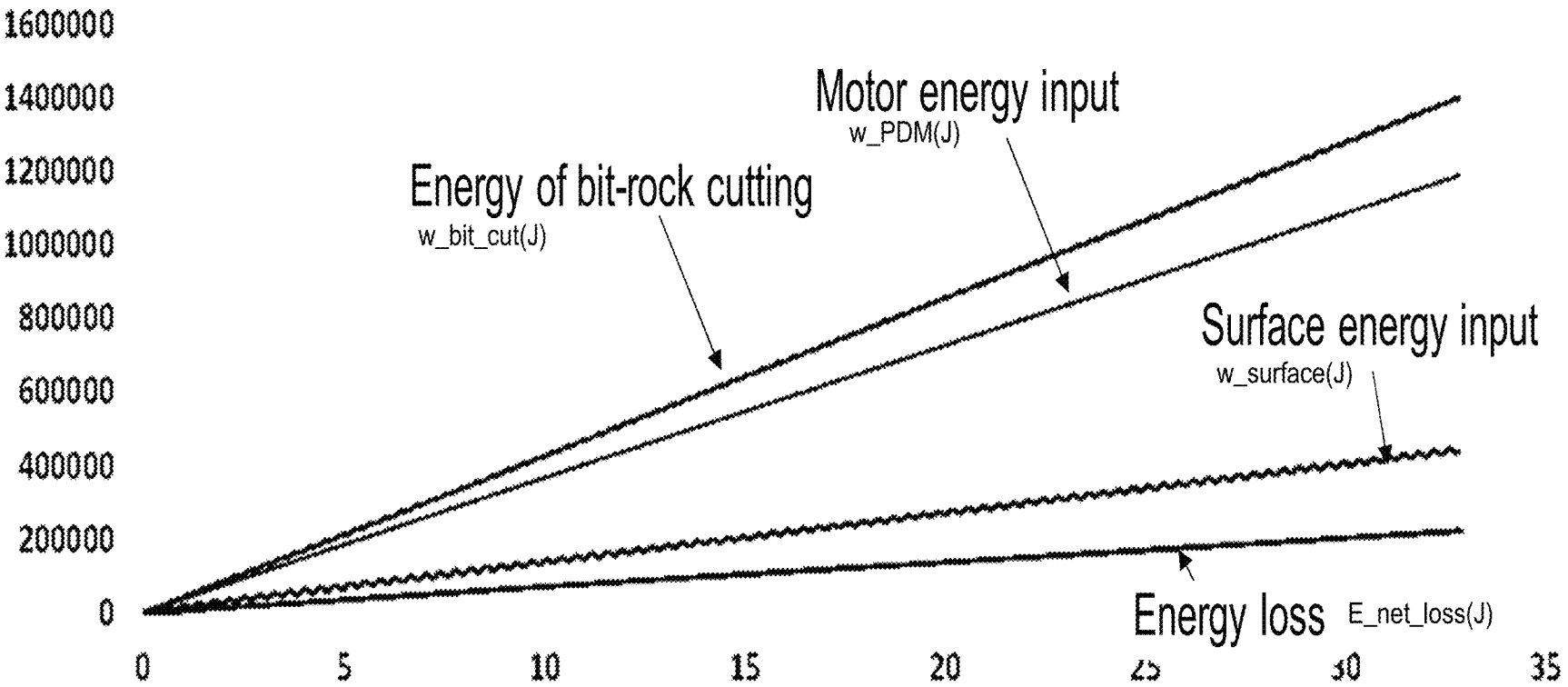
FIG. 16 shows a graph of energy with reference to motor speed and drill string surface rotation speed. Energy losses are shown in the graph.

FIG. 15 illustrates an example drill string and BHA for a simulation that includes a drilling motor (shown proximate the drill bit in the left hand panel of FIG. 15. In the present example, energy input and energy loss may be calculated for both the rotary input at the surface (top drive or rotary table) and the drilling motor. Referring to FIG. 16, energy input for both the top drive and the drilling motor, as well as their respective energy losses are shown graphically. Energy input at the motor is about three times that provided at surface top drive.

Figure 17:
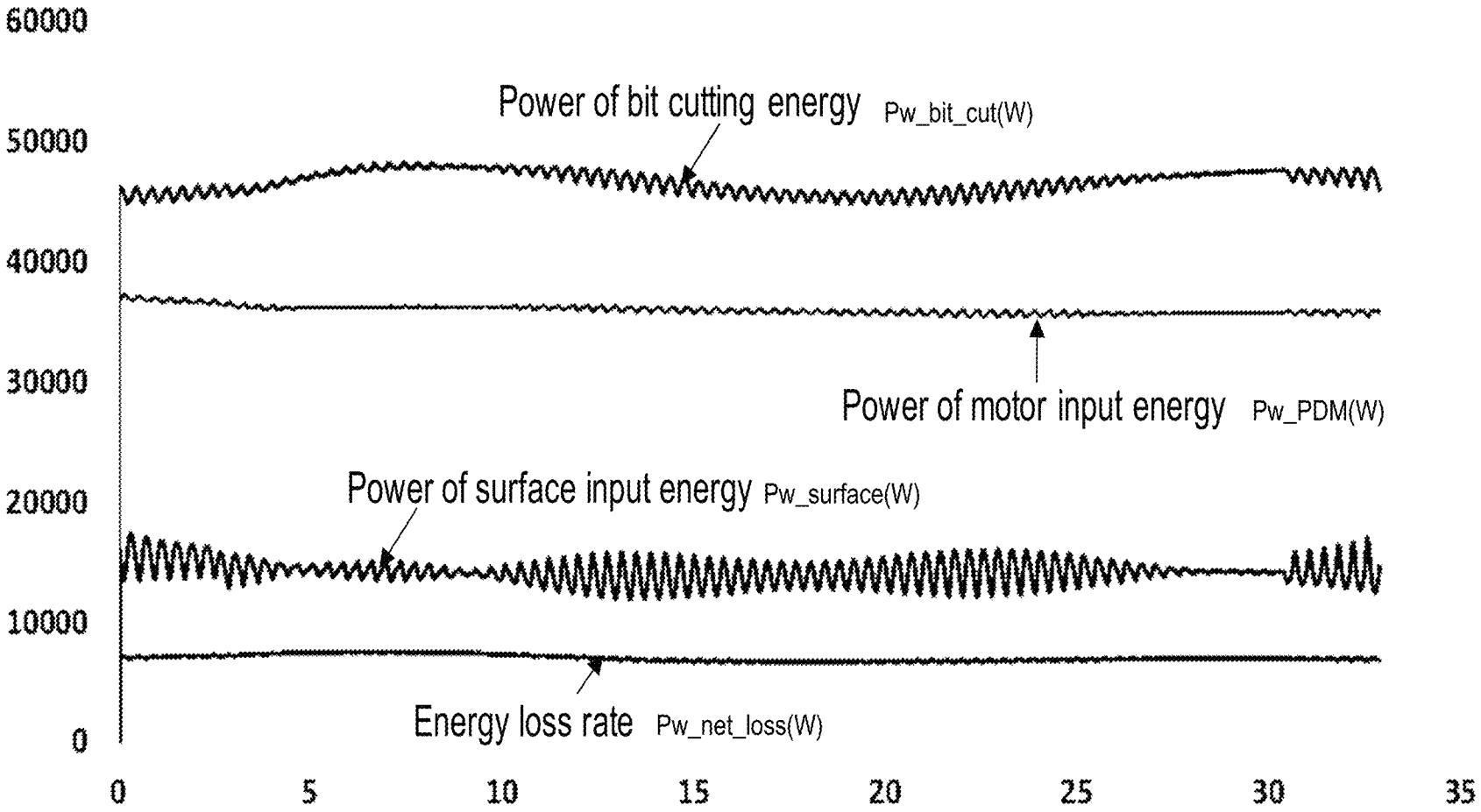
FIG. 17 shows a graph of the case wherein RPM=50, WOB=10,000 lbs., drilling fluid flow is 350 gallons per minute. Energy is calculated as Power (5 sec moving average). Calculated energy loss is about 12% of the total energy input (surface+drilling motor).

FIG. 17 shows a graph of power and power loss for both the top drive and the drilling motor. Energy loss is about 12% of the total energy input (top drive [or rotary table]+motor).

In other embodiments, a different procedure may be used to determine parasitic energy loss, i.e., energy consumed other than by drilling formations. The total energy applied to the drill string (and to the drill bit when a drilling motor is used) is described in Eqs. (5) and (6). The amount of work (energy) consumed by drilling formations is described by Eq. (7). Total energy losses from any or all of the parameters described herein will be represented by the difference between the total energy input (Eqs. 5 and/or 6) and the energy used in drilling formations (Eq. 7).

To summarize the present disclosure and possible benefits of a method according to the present disclosure, subsurface formation drilling is a process in which energy is input at the surface and in some example embodiments by a drilling motor in the drill string. The energy is transferred through the drill string and BHA, and is then used to drill formations below the drill bit. Part of the energy input may be converted to drill string elastic strain/kinetic energy, and as well as being dissipated due to contact friction between the drill string and the wall of the wellbore. The amounts of energy used to drill the formations and the amount of energy lost due to any or all of the foregoing factors may be calculated.

Drill string strain energy and kinetic energy reflect how much energy resides in the drill string in the form of elastic deformation and dynamic motion. These parameters may be used as state indicators for the entire drill string deformation and vibration. Energy loss is an effective measure of drilling efficiency. A transient dynamic simulation method may be useful for energy calculation because such methods output a continuous history of kinetic and force responses of entire drill string.

Clear signatures of strain energy and kinetic energy can be found for different vibration modes using a method according to the present disclosure.

In a further embodiment, if the calculations suggest excessive amounts of input energy are being dissipated by any one or more of the foregoing energy dissipating interactions of the drill string and/or accelerations of the drill string, one or more drilling operating parameters may be adjusted in order to reduce the dissipated energy, thereby transferring more of the input energy into drilling the formations.

The drilling system design can affect drilling energy input and transfer during drilling. Selection of different bits, reamers, mud motors, and other bottom hole assembly tools can affect how effective the energy is utilized to destroy the formation. The disclosed energy calculation based on drilling dynamics simulation can be applied to plan drilling system for a specific job, including selection of drill bits, drilling tools and drill stems, placement of drilling tools, design of well bore sizes and trajectory, selection of drilling parameters, etc. Energy calculation can be conducted based on the planned drill string and wellbore trajectory to assess the energy input requirements for the planned drilling operation. This information can be used to guide the selection of proper surface power supply and downhole drive system (such as motor and turbine). Since kinetic energy and strain energy of drill string represent the energy possessed by drill string in the form of vibration and deformation, they can be used as performance indicators of the entire drill string. In the well planning stage, the kinetic energy for different drilling systems can be calculated and relatively compared to help choose the most stable one (with least kinetic energy) for a specific job. The kinetic energy can be applied to compare the drilling stability of different drilling parameters. The kinetic energy of drill system can be compared to a pre-specified threshold to evaluate if the vibration level is acceptable or not. The strain energy indicator can be utilized to evaluate the robustness of drill string. Lower strain energy means smaller deformation and lower stress. The strain energy can be applied to plan drilling system and practice to lower the drill string lost-in-hole failure risk. The effective usage of drilling energy is to drilling formation. The difference between energy input and energy used for formation drilling is energy loss, which can be used as a drilling efficiency indicator. The energy calculation can be conducted in the planning phase to compare energy loss for different drilling systems and different drilling parameters. Among the several given BHA options and drilling parameter range derived from offset well experiences and tool limits, an optimization process can be performed to select BHA and parameters yielding the lowest energy loss.

During execution phase, simulation of different drilling parameters can be conducted during drilling. Energy calculation can be done for each simulated scenarios to help select favorable drilling parameters or adjust downhole tool functions. The depth-by-depth lithology data of offset well is used to map the formation top in the current well before drilling. This helps select the rock type used in drilling dynamics simulation. A bit wear model can be built into dynamic simulation to predict the dull condition of bit based on the cutter loading conditions, travel velocity, and formation abrasiveness. The downhole logging tool can send the real-time downhole dynamics and mechanics measurement data to surface. These information can be used to calculate the strain and kinetic energy of drill string at the measurement location. When the discrepancy between simulated and measured energy parameters is found, a real-time calibration process for drilling dynamics model is activated to adjust modeling parameters to match the downhole measurements. The calibrated dynamics model can be used to calculate the real-time energy distribution in the drill string and to predict the energy input requirement for the upcoming operations. The kinetic energy indicator can be closely monitored through the real-time simulation to identify the adverse downhole vibration modes (such as stick-slip or backward whirling) based on comparison of indicator with specific thresholds. The strain energy can be calculated during drilling to identify the overloading condition of drill string and to raise warning to driller when a specific threshold is exceeded. A poor drilling efficiency condition can be identified by monitoring when the predicted energy loss ratio is higher than a certain threshold.

Figure 18:
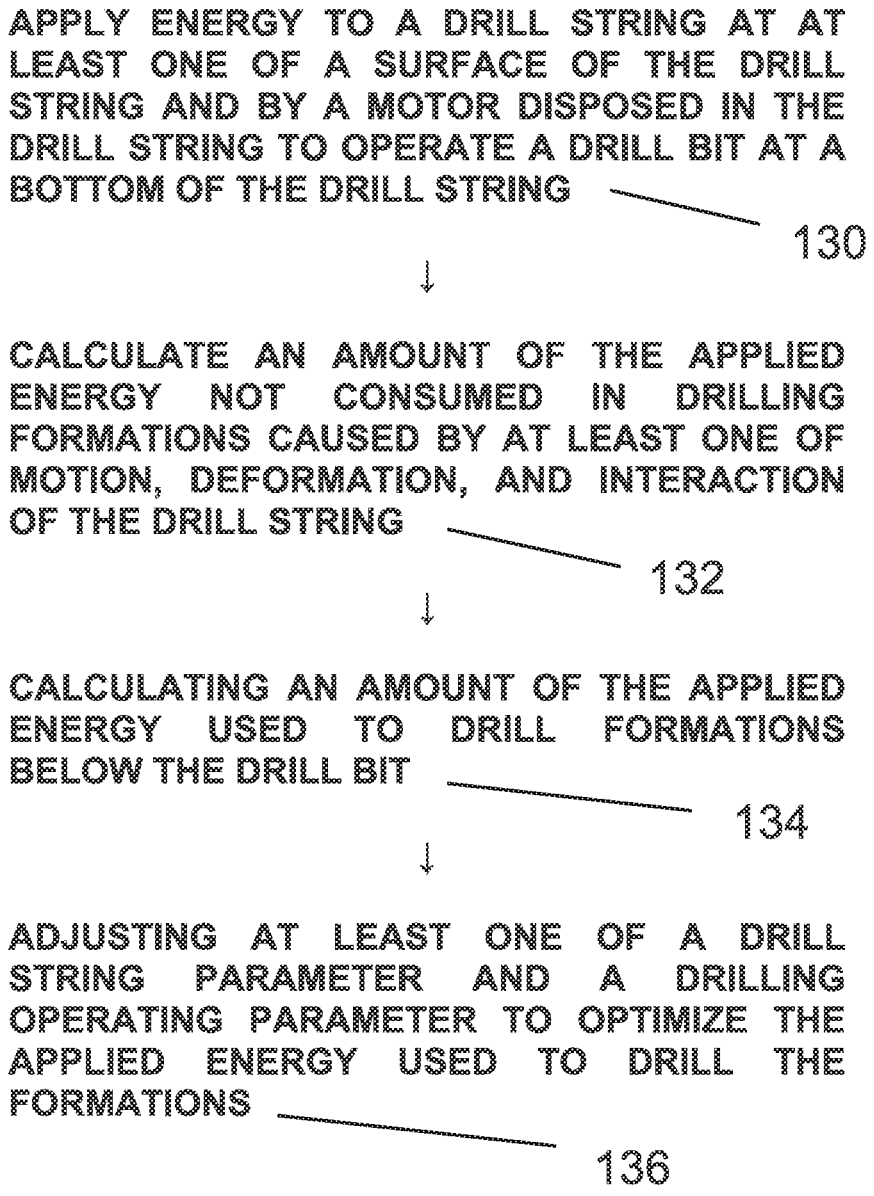
FIG. 18 shows a flow chart of an example embodiment of a method according to the present disclosure.

The calculation could be conducted during the post well analysis stage. The actual drilling system and parameters used in the job can be simulated to understand energy input, energy transfer, and the energy dissipation. The downhole measurement data from logging tools and surface drilling data can be used to calibrate the dynamics model. The calibrated model is utilized to analyze how the energy is distributed in drill string and to identify the sources/factors leading to poor drilling efficiency condition (high energy loss ratio) and severe shock and vibration (high kinetic energy). The energy calculation can be also used to troubleshoot the cause of downhole tool failures such as twist off. The energy calculation procedure can be applied to evaluate the new proposed drilling system and drilling practices to identify the possible improvement areas for future jobs. A flow chart of one example embodiment of a method according to the present disclosure is shown in FIG. 18, in which at 130 energy is applied to to a drill string at at least one of a surface of the drill string and by a motor disposed in the drill string to operate a drill bit at a bottom of the drill string. At 132 an amount of the applied energy not consumed in drilling formations caused by at least one of motion, deformation, and interaction of the drill string is calculated. At 134 an amount of the applied energy used to drill formations below the drill bit is calculated. Finally, at 136 at least one of a drill string parameter and a drilling operating parameter to optimize the applied energy used to drill the formations is adjusted.

Figure 19:
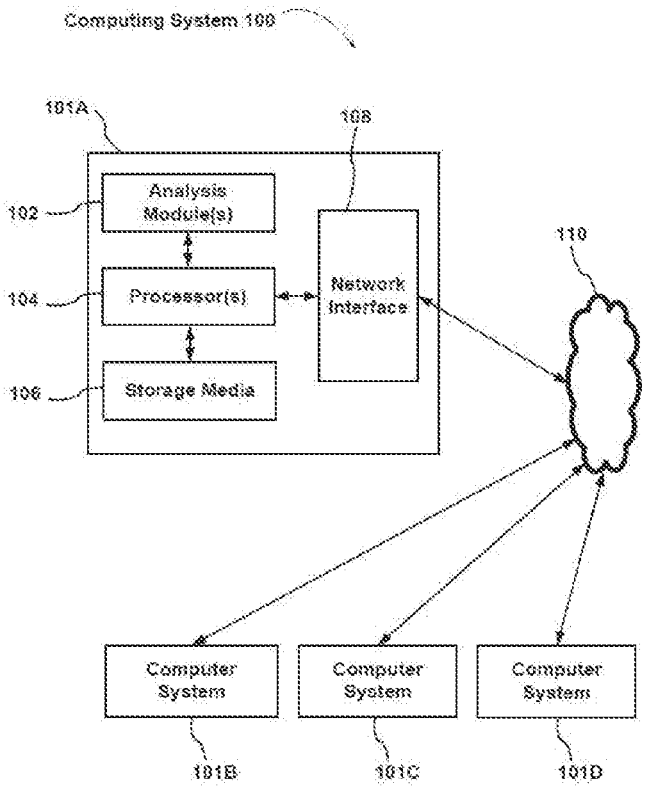
FIG. 19 shows an example computer system that may be used in some embodiments.

FIG. 19 shows an example computing system 100 in accordance with some embodiments. The computing system 100 may be an individual computer system 101A or an arrangement of distributed computer systems. The individual computer system 101A may include one or more analysis modules 102 that may be configured to perform various tasks according to some embodiments, such as the tasks explained with reference to FIGS. 2 through 18. To perform these various tasks, the analysis module 102 may operate independently or in coordination with one or more processors 104, which may be connected to one or more storage media 106. A display device 105 such as a graphic user interface of any known type may be in signal communication with the processor 104 to enable user entry of commands and/or data and to display results of execution of a set of instructions according to the present disclosure.

The processor(s) 104 may also be connected to a network interface 108 to allow the individual computer system 101A to communicate over a data network 110 with one or more additional individual computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be at a well drilling location, while in communication with one or more computer systems such as 101C and/or 101D that may be located in one or more data centers on shore, aboard ships, and/or located in varying countries on different continents).

A processor may include, without limitation, a microprocessor, microcontroller, processor module or subsystem, programmable integrated circuit, programmable gate array, or another control or computing device.

The storage media 106 may be implemented as one or more computer-readable or machine-readable storage media. Note that while in the example embodiment of FIG. the storage media 106 are shown as being disposed within the individual computer system 101A, in some embodiments, the storage media 106 may be distributed within and/or across multiple internal and/or external enclosures of the individual computing system 101A and/or additional computing systems, e.g., 101B, 101C, 101D. Storage media 106 may include, without limitation, one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that computer instructions to cause any individual computer system or a computing system to perform the tasks described above may be provided on one computer-readable or machine-readable storage medium, or may be provided on multiple computer-readable or machine-readable storage media distributed in a multiple component computing system having one or more nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that any other embodiment of a computing system may have more or fewer components than shown, may combine additional components not shown in the example embodiment of FIG. 19, and/or the computing system 100 may have a different configuration or arrangement of the components shown in FIG. 19. The various components shown in FIG. 19 may be implemented in hardware, software, or a combination of both hardware and software, including one or more signal processing and/or application specific integrated circuits.

Further, the acts of the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method for drilling a well, comprising:

applying energy to a drill string y at least one of a surface of the drill string and by a motor disposed in the drill string to operate a drill bit at a bottom of the drill string;

calculating an amount of the applied energy not consumed in drilling formations caused by at least one of motion, deformation, and interaction of the drill string;

calculating an amount of the applied energy used to drill formations below the drill bit;

calculating a rate of penetration that depends on the applied energy and the amount of the applied energy not consumed in drilling formations and the amount of the applied energy used to drill formations; and utilizing the calculations, adjusting at least one of a drill string parameter and a drilling operating parameter to control the applied energy used to drill the formations.

2. The method of claim 1 wherein the motion of the drill string comprises axial translational motion at a plurality of locations along the drill string.

3. The method of claim 1 wherein the motion of the drill string comprises torsional rotation at a plurality of locations along the drill string.

4. The method of claim 1 wherein the motion of the drill string comprises lateral translational motion at a plurality of locations along the drill string.

5. The method of claim 1 wherein the deformation of the drill string comprises axial contraction/extension and lateral bending at a plurality of locations along the drill string.

6. The method of claim 1 wherein the deformation of the drill string comprises rotational twist at a plurality of locations along the drill string.

7. The method of claim 1 wherein the applying energy at the surface comprises rotating at least one of a top drive and a rotary table.

8. The method of claim 1 wherein the interaction of the drill string comprises frictional contact between the drill string and a wall of the wellbore at a plurality of locations along the drill string.

9. The method of claim 1 wherein the at least one drilling operating parameter comprises hookload.

10. The method of claim 1 wherein the at least one drilling operating parameter comprises rotational speed of the drill bit.

11. The method of claim 1 wherein the at least one drilling operating parameter comprises drilling fluid flow rate through the drill string.

12. The method of claim 1 further comprising characterizing a mode of motion of the drill string using the calculated energy amounts.

13. A method for drilling a well, comprising:

rotating a drill string having a drill bit at a bottom end on formations disposed below the drill bit;

determining a total amount of energy input applied to the drill string by at least one of rotating the drill string from a surface location and operating a drilling motor in the drill string;

calculating an amount of energy expended by drilling the formations below the drill bit, wherein the calculating comprises calculating a rate of penetration;

determining an amount of the applied energy not consumed in drilling formations caused by at least one of motion, deformation, and interaction of the drill string as a difference between the total amount of energy input applied to the drill string and the amount of energy expended drilling the formations; and based at least in part on the difference, adjusting at least one drilling operating parameter to control the amount of energy expended drilling the formations.

14. The method of claim 13 wherein the motion of the drill string comprises axial translational motion at a plurality of locations along the drill string.

15. The method of claim 13 wherein the motion of the drill string comprises torsional rotation at a plurality of locations along the drill string.

16. The method of claim 13 wherein the motion of the drill string comprises lateral translational motion at a plurality of locations along the drill string.

17. The method of claim 13 wherein the deformation of the drill string comprises axial contraction/extension and lateral bending at a plurality of locations along the drill string.

18. The method of claim 13 wherein the deformation of the drill string comprises rotational twist at a plurality of locations along the drill string.

19. The method of claim 13 wherein the applying rotational energy at the surface comprises rotating at least one of a top drive and a rotary table.

20. The method of claim 13 wherein the interaction of the drill string comprises frictional contact between the drill string and a wall of the wellbore at a plurality of locations along the drill string.

21. The method of claim 13 wherein the at least one drilling operating parameter comprises hookload.

22. The method of claim 13 wherein the at least one drilling operating parameter comprises rotational speed of the drill bit.

23. The method of claim 13 wherein the at least one drilling operating parameter comprises drilling fluid flow rate through the drill string.

24. The method of claim 13 further comprising characterizing a mode of motion of the drill string using the calculated energy amounts.

* * * * *